US009435206B2

(12) United States Patent
Johnson et al.

(10) Patent No.: US 9,435,206 B2
(45) Date of Patent: Sep. 6, 2016

(54) FLOW INDUCER FOR A GAS TURBINE SYSTEM

(75) Inventors: Richard William Johnson, Greer, SC (US); Bradley James Miller, Simpsonville, SC (US); David Martin Johnson, Simpsonville, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 1001 days.

(21) Appl. No.: 13/610,839

(22) Filed: Sep. 11, 2012

(65) Prior Publication Data

US 2014/0072420 A1 Mar. 13, 2014

(51) Int. Cl.
*F01D 5/08* (2006.01)
*F01D 25/12* (2006.01)

(52) U.S. Cl.
CPC ..... *F01D 5/081* (2013.01); *F01D 5/084* (2013.01); *F01D 25/12* (2013.01)

(58) Field of Classification Search
CPC ..... F01D 5/081; F01D 5/082; F01D 5/084; F01D 5/087; F01D 5/088; F01D 5/14; F01D 9/06; F01D 9/065; F01D 25/125; F05D 2240/126; F05D 2240/127; F05D 2260/209; F05D 2260/2212; F05D 2260/2214; F05D 2260/22141; F05D 2260/232
USPC ... 415/115, 116; 416/95, 96 R, 97 R, 198 A, 416/210 R
See application file for complete search history.

(56) References Cited

U.S. PATENT DOCUMENTS

| | | | | | |
|---|---|---|---|---|---|
| 2,988,325 | A | * | 6/1961 | Dawson | 415/110 |
| 3,565,545 | A | * | 2/1971 | Bobo et al. | 16/90 R |
| 3,602,605 | A | * | 8/1971 | Lee et al. | 415/116 |
| 3,791,758 | A | * | 2/1974 | Jenkinson | 415/116 |
| 3,826,084 | A | * | 7/1974 | Branstrom et al. | 60/806 |
| 3,832,090 | A | * | 8/1974 | Matto | 416/95 |
| 3,990,812 | A | * | 11/1976 | Radtke | 416/95 |
| 4,113,406 | A | * | 9/1978 | Lee et al. | 415/115 |
| 4,178,129 | A | * | 12/1979 | Jenkinson | 416/95 |
| 4,184,326 | A | * | 1/1980 | Pane et al. | 60/759 |
| 4,236,869 | A | * | 12/1980 | Laurello | 416/95 |
| 4,435,123 | A | * | 3/1984 | Levine | 416/95 |
| 4,526,511 | A | * | 7/1985 | Levine | 416/95 |
| 4,541,774 | A | * | 9/1985 | Rieck et al. | 415/115 |
| 4,674,955 | A | * | 6/1987 | Howe et al. | 416/95 |
| 4,720,235 | A | * | 1/1988 | Lachance et al. | 415/58.1 |
| 4,730,978 | A | * | 3/1988 | Baran, Jr. | 415/115 |
| 4,759,688 | A | * | 7/1988 | Wright et al. | 416/95 |
| 4,882,902 | A | * | 11/1989 | Reigel et al. | 60/806 |
| 4,887,663 | A | * | 12/1989 | Auxier | F02K 1/822 165/47 |
| 5,245,821 | A | | 9/1993 | Thomas, Jr. et al. | |
| 5,252,026 | A | * | 10/1993 | Shepherd | 415/115 |
| 5,402,636 | A | * | 4/1995 | Mize et al. | 60/806 |
| 5,575,616 | A | * | 11/1996 | Hagle et al. | 415/115 |

(Continued)

*Primary Examiner* — Craig Kim
*Assistant Examiner* — Wayne A Lambert
(74) *Attorney, Agent, or Firm* — Fletcher Yoder, P.C.

(57) ABSTRACT

A system includes an inducer assembly configured to receive a fluid flow from compressor fluid source and to turn the fluid flow in a substantially circumferential direction into the exit cavity. The inducer assembly includes multiple flow passages. Each flow passage includes an inlet configured to receive the fluid flow and an outlet configured to discharge the fluid flow into the exit cavity, and each flow passage is defined by a first wall portion and a second wall portion extending between the inlet and the outlet. The first wall portion includes a first surface adjacent the outlet that extends into the exit cavity.

2 Claims, 9 Drawing Sheets

(56) References Cited

U.S. PATENT DOCUMENTS 5,592,821 A * 1/1997 Alary et al. ..... 60/751
6,050,079 A 4/2000 Durgin et al.
6,183,193 B1 * 2/2001 Glasspoole et al. ..... 415/115
6,234,746 B1 * 5/2001 Schroder et al. ..... 415/115
6,276,896 B1 * 8/2001 Burge ..... F01D 5/048 415/115
6,290,464 B1 * 9/2001 Negulescu et al. ..... 416/97 R
6,361,277 B1 * 3/2002 Bulman et al. ..... 416/96 R
6,379,117 B1 * 4/2002 Ichiryu ..... 416/96 R
6,398,487 B1 * 6/2002 Wallace et al. ..... 415/115
6,398,488 B1 * 6/2002 Solda et al. ..... 415/115
6,468,032 B2 * 10/2002 Patel ..... 415/115
6,537,025 B2 * 3/2003 Hopkins ..... F03D 1/04 415/202
6,773,225 B2 * 8/2004 Yuri et al. ..... 415/1
6,969,237 B2 * 11/2005 Hudson ..... 416/97 R
6,981,845 B2 * 1/2006 Balland ..... F01D 5/081 416/248
7,048,497 B2 * 5/2006 Arilla et al. ..... 415/116
8,047,768 B2 * 11/2011 Deodhar ..... F01D 5/066 415/115
8,066,473 B1 * 11/2011 Aho, Jr. ..... 415/112
8,584,469 B2 * 11/2013 Laurello et al. ..... 60/806
8,677,766 B2 * 3/2014 Laurello et al. ..... 60/806
8,708,652 B2 * 4/2014 Caprario ..... F01D 5/082 416/220 R
8,721,264 B2 * 5/2014 Behaghel ..... F01D 5/082 415/115
9,068,461 B2 * 6/2015 Laurello et al.
2003/0031555 A1 2/2003 Noe et al.
2008/0141677 A1 * 6/2008 Brillert ..... 60/785
2008/0310950 A1 * 12/2008 Young ..... F01D 5/082 415/116
2011/0189000 A1 8/2011 Vedhagiri et al.
2012/0087784 A1 4/2012 Widener
2013/0051976 A1 * 2/2013 Kirtley ..... 415/1

* cited by examiner

FLOW INDUCER FOR A GAS TURBINE SYSTEM

BACKGROUND OF THE INVENTION

The subject matter disclosed herein relates to gas turbines and, more particularly, to a flow inducer for gas turbines.

Gas turbine engines typically include cooling systems (e.g., inducer) which provide cooling air to turbine rotor components, such as turbine blades, in order to limit the temperatures experienced by such components. However, the structure of the cooling systems or interaction of certain components of the cooling system may limit the efficiency of the cooling systems. For example, the ability to achieve lower cooling temperatures for a cooling fluid flow may be limited, which may adversely impact the efficiency and performance of the gas turbine engine.

BRIEF DESCRIPTION OF THE INVENTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In accordance with a first embodiment, a system includes an inducer assembly configured to receive a fluid flow from a compressor fluid source and to turn the fluid flow in a substantially circumferential direction into the exit cavity. The inducer assembly includes multiple flow passages. Each flow passage includes an inlet configured to receive the fluid flow and an outlet configured to discharge the fluid flow into the exit cavity, and each flow passage is defined by a first wall portion and a second wall portion extending between the inlet and the outlet. The first wall portion includes a first surface adjacent the outlet that extends into the exit cavity.

In accordance with a second embodiment, a system includes a gas turbine engine that includes a compressor, a turbine, a casing, and a rotor. The casing and the rotor are disposed between the compressor and turbine, and the casing and the rotor define a cavity to receive a first fluid flow from the compressor. The gas turbine engine also includes an inducer assembly disposed between the compressor and the turbine. The inducer assembly is configured to receive a second fluid flow from the compressor and to turn the second fluid flow in a substantially circumferential direction into the cavity. The inducer assembly includes multiple flow passages. Each flow passage includes an inlet configured to receive the second fluid flow and an outlet configured to discharge the second fluid flow into the cavity and is defined by a first wall portion and a second wall portion extending between the inlet and the outlet. The first wall portion includes a first surface adjacent the outlet that extends into the cavity.

In accordance with a third embodiment, a system includes an inducer assembly configured to receive a fluid flow from compressor fluid source and to turn the fluid flow in a substantially circumferential direction into an exit cavity. The inducer includes at least one flow passage that includes an inlet configured to receive the fluid flow and an outlet configured to discharge the fluid flow into the exit cavity. The at least one flow passage is defined by a first wall portion and a second wall portion extending between the inlet and the outlet. The first wall portion includes a first surface adjacent the outlet that extends into the exit cavity and a second surface. The second surface is configured to enable exit of the fluid flow from the outlet in a substantially tangential direction relative to a cross-sectional area of the exit cavity. The first surface is configured to guide a cavity fluid flow away from the fluid flow exiting from the outlet.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

Figure 1:
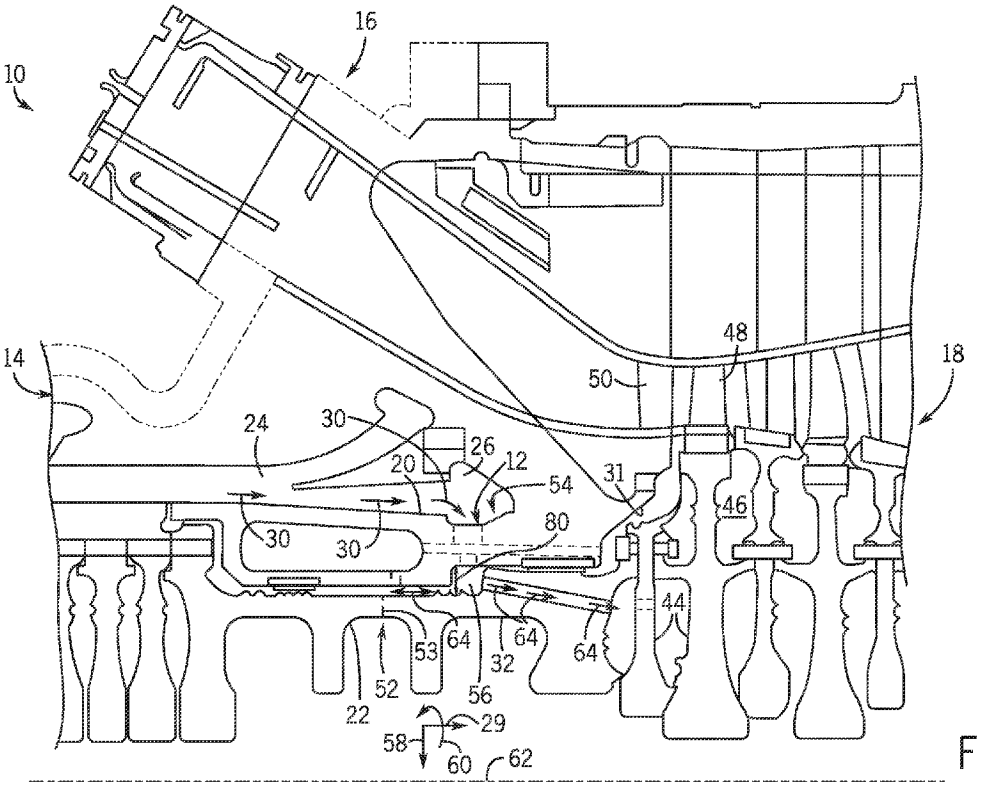
FIG. 1 is a cross-sectional side view of an embodiment of a portion of a gas turbine engine having an inducer assembly.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

The present disclosure is generally directed towards a fluid flow inducer assembly (e.g., axial or radial inducer assembly) for cooling in a gas turbine engine, wherein the inducer assembly has contoured shaped discharge regions to generate high swirl with a reduced pressure drop. In certain embodiments, the inducer assembly receives a fluid flow (e.g., air) from a compressor or other source and turns the fluid flow in a substantially circumferential direction into an exit cavity (e.g., defined by a stator component of a casing and rotor). The inducer assembly includes a plurality of flow passages or inducers (e.g., disposed circumferentially about a support structure relative to a rotational axis of the turbine engine). Each flow passage includes an inlet and an outlet and is defined by a first wall portion (e.g., discharge scoop formed of one or more segments or parts) and a second wall portion extending between the inlet and outlet. The first wall portion includes a first surface adjacent the outlet that extends into the exit cavity (e.g., relative to an aft bottom or inner surface of a flow passage structure). This enables a higher exit flow angle (e.g., ranging from approximately 60 to 90 degrees). The first surface guides a portion of the cavity fluid flow away from the fluid flow (e.g., inducer fluid flow) exiting from the outlet. In certain embodiments, the first wall portion includes at least one groove or hole in the first surface to guide another portion of the cavity fluid flow along or through the first wall portion into the fluid flow exiting from the outlet. Also, the first surface may include a smoothly contoured curve at an end portion. The first wall portion also includes a second surface that turns the fluid flow in the substantially circumferential direction. In addition, the second surface enables exit of the fluid flow from the outlet in a substantially tangential direction relative to a cross-sectional area of the exit cavity. In certain embodiments, the first wall portion may include at least groove in the second surface to straighten the fluid flow prior to exiting from the outlet. In some embodiments, the first wall portion includes at least one projection extending from the second surface perpendicular to a direction of the fluid flow from the inlet to the outlet to minimize flow tripping. The contoured design of the discharge regions (e.g., scoops) of the inducer assembly may increase the efficiency of the inducer assembly by minimizing the mixing losses (e.g., pressure drop) as the inducer fluid flow merges with the exit cavity fluid flow. The increased efficiency of the inducer assembly results in more cavity swirl and lower relative temperatures for the cooling fluid flow. The lower temperatures in the cooling fluid flow may reduce flow requirements for cooling turbine blades, improve the life of turbine blades, and improve the overall performance of the gas turbine engine.

Turning now to the figures, FIG. 1 is a cross-sectional side view of an embodiment of a portion of a gas turbine engine 10 having a fluid flow inducer assembly 12 (e.g., axial or radial inducer assembly) for routing cooling fluid flow (e.g., air flow) toward the turbine section of the engine 10. Although discussed in relation to a gas turbine engine, the inducer assembly 12 or its inducers may be used in other applications. As discussed in greater detail below, the inducer assembly 12 includes contoured shaped discharge regions to generate high swirl with a reduced pressure drop. The gas turbine engine 10 includes a compressor 14, a combustor 16, and a turbine 18. In certain embodiments, the gas turbine engine 10 may include more than one compressor 14, combustor 16, and/or turbine 18. The compressor 14 and the turbine 18 are coupled together as discussed below. The compressor 14 includes a compressor stator component 20, a portion of which may be known as a compressor discharge casing, and an inner rotor component 22 (e.g., compressor rotor). The compressor 14 includes a diffuser 24 at least partially defined by the compressor stator component 20. The compressor 14 includes a discharge plenum 26 adjacent to and in fluid communication with the diffuser 24. A fluid (e.g., air or a suitable gas), referred to as a fluid flow 30, travels through and is pressurized within the compressor 14. The diffuser 24 and the discharge plenum 26 guide a portion of the fluid flow 30 to the combustor 16. In addition, the diffuser 24 and the discharge plenum 26 guide another portion of the fluid flow 30 in an axial direction 29 towards the inducer 12.

The turbine 18 includes a turbine stator component 31 and an inner rotor component 32 (e.g., turbine rotor). The rotor component 32 may be joined to one or more turbine wheels 44 disposed in a turbine wheel space 46. Various turbine rotor blades 48 are mounted to the turbine wheels 44, while turbine stator vanes or blades 50 are disposed in the turbine 18. The rotor blades 48 and the stator blades 50 form turbine stages. The adjoining ends of the compressor rotor 22 and the turbine rotor 32 may be joined (e.g., bolted together) to each other to form an inner rotary component or rotor 52. A rotor joint 53 may join the adjoining ends of the rotors 22, 32. The adjoining ends of the compressor stator component 20 and the turbine stator component 31 may be coupled to each other (e.g., bolted together) to form an outer stationary casing 54 surrounding the rotor 52. In certain embodiments, the compressor stator component 20 and the turbine stator component 31 form a singular component without need of flanges or joints to form the casing 54. Thus, the components of the compressor 14 and the turbine 16 define the rotor 52 and the casing 54. As described, the compressor and turbine components define the cavity 56. However, depending on the location of the inducer assembly 12 or inducers, the cavity 56 may be defined solely by turbine components. For example, the inducer assembly 12 or inducer may be disposed between turbine stages.

The rotor 52 and the casing 54 further define a forward wheel space 56 (e.g., cavity or exit cavity) therebetween. The forward wheel space 56 may be an upstream portion of the wheel space 46. The rotor joint 53 and the wheel space 46 may be accessible through the forward wheel space 56.

In the disclosed embodiments, the inducer assembly 12 facilitates cooling of the wheel space 46 and/or rotor joint 53 to be cooled. The inducer assembly 12 receives a portion of the fluid flow 30 from the compressor 14 in a generally radial direction 58 and directs the fluid flow 30 into the cavity 56 to generate a cavity fluid flow. In certain embodiments, the inducer assembly 12 may receive the fluid flow from a source (e.g., fluid flow source) external to the gas turbine 10 (e.g., waste fluid from an IGCC system). In addition, the inducer assembly 12 directs a portion of the fluid flow 30 (e.g., inducer fluid flow) in a substantially circumferential direction 60 relative to a longitudinal axis 62 (e.g., rotational axis) of the gas turbine engine 10 to merge with the cavity fluid flow to form a cooling medium 64 (e.g., cooling fluid flow). Thus, the inducer assembly 12 generates a high swirl within the cooling fluid flow 64. The cooling fluid flow 64 may be directed toward the wheel space 46 and/or the rotor joint 53. In particular, a portion of the cooling fluid flow 64 may flow through the cavity 56 to interact with and cool the wheel space 46 and/or the rotor joint 53. As described in greater detail below, the discharge regions (e.g., scoops) of the inducer assembly 12 include a contoured design. The contoured design of the discharge regions of the inducer assembly 12 may increase the efficiency of the inducer assembly 12 by minimizing the mixing losses (e.g., pressure drop) as the inducer fluid flow merges with an exit cavity fluid flow. The increased efficiency of the inducer assembly 12 results in more cavity swirl and lower relative temperatures for the cooling fluid flow. The lower temperatures in the cooling fluid flow may reduce flow requirements for cooling the turbine blades 48, improve the life of the blades 48, and improve the overall performance of the gas turbine engine 10.

Figure 2:
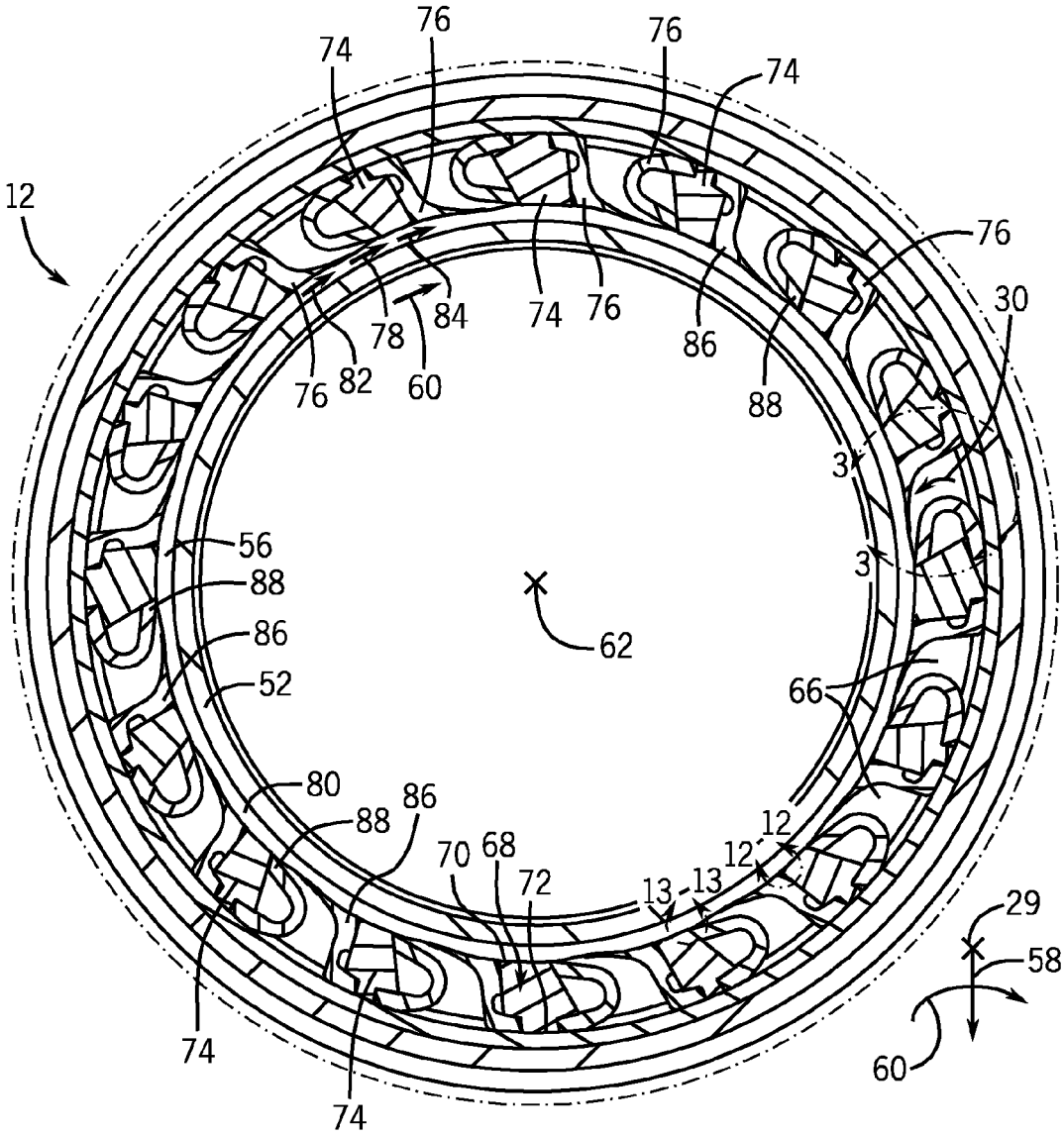
FIG. 2 is a cross-sectional view of an embodiment of an inducer assembly having a plurality of flow passages or inducers.

FIG. 2 is a cross-sectional view of an embodiment of the inducer assembly 12 having a plurality of flow passages or inducers 66. The inducer assembly 12 includes a support structure 68 (e.g., inner barrel) having an inner surface 70 (e.g., annular inner surface) and an outer surface 72 (e.g., annular outer surface). In certain embodiments, the support structure 68 may be part of the outer stationary casing 54 (e.g., compressor stator component 20 and/or turbine stator component 31). The support structure 68 (e.g., casing 54) and the rotor 52 define the cavity (e.g. annular cavity) or exit cavity 56 (e.g., free wheel space). The plurality of flow passages 66 is disposed circumferentially 60 about the support structure 68 between the inner surface 70 and the outer surface 72. The number of flow passages 66 may range from 1 to 100. Portions 74 of the support structure 68 may be disposed between structures 76 (e.g., flow passage structure) defining the flow passages 66. Each structure 76 may be formed of a single part (e.g., cast monolith) or multiple parts (e.g., machined in two halves). Each flow passage 66 receives a portion of the fluid flow 30 from the compressor 14 and turns the fluid flow in a substantially circumferential direction 60 into the exit cavity 56. In particular, each flow passage 66 enables the exit of the fluid flow 30 into the exit cavity 56 in a substantially tangential direction, as indicated by arrow 78, relative to a cross-sectional area 80 (e.g., annular cross-sectional area) of the exit cavity 56. The fluid flow 30 exits each flow passage 66 at an exit flow angle 102 ranging between approximately 60 to 90 degrees, 60 to 75 degrees, 75 to 90 degrees, and all subranges therebetween relative to an exit plane 104 (e.g., radial exit plane) at an outlet of each flow passage (see FIG. 3). For example, the exit flow angle 102 may be approximately 60, 65, 70, 75, 80, 85, or 90 degrees, or any other angle. The exiting fluid flow 78 (e.g., inducer fluid flow) merges with an exit cavity fluid flow 82 to form a cooling medium 84 (e.g., cooling fluid flow). In addition, the exiting fluid flow 78 imparts swirl in the cooling fluid flow 84 (e.g., flow in the circumferential direction 60 about axis 62).

Figure 12:
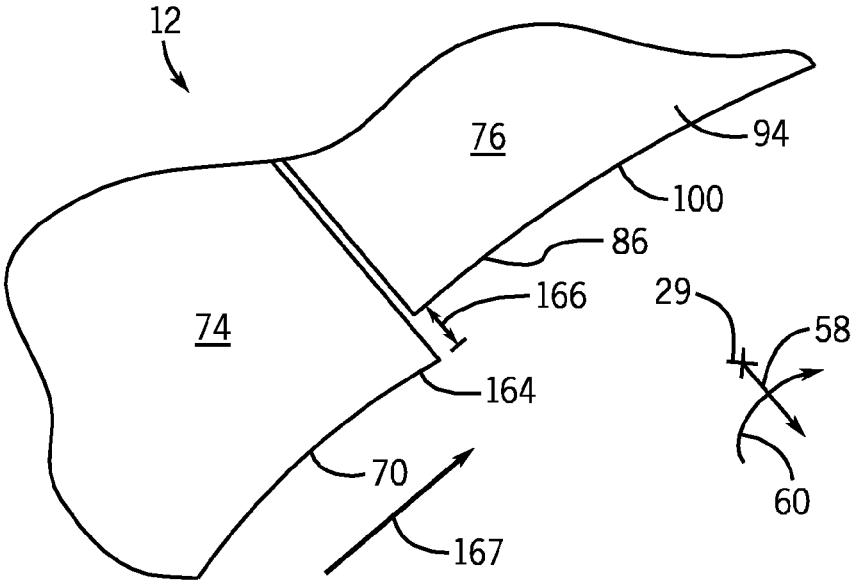
FIG. 12 is a partial view of an embodiment of a portion of the inducer of FIG. 2 taken within line 12-12 (e.g., support structure portion and adjacent aft bottom portion of a flow passage structure)
Figure 13:
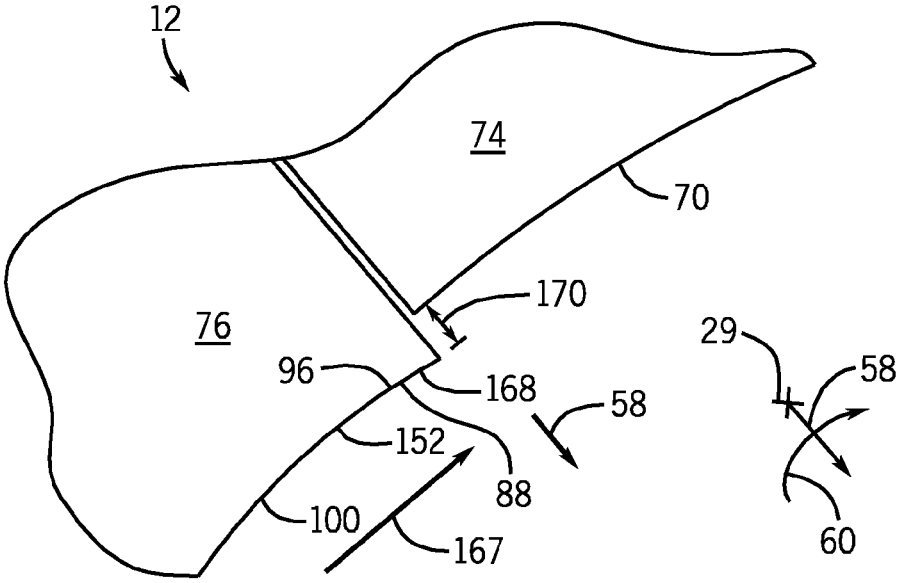
FIG. 13 is a partial view of an embodiment of a portion of the inducer of FIG. 2 taken within line 13-13 (e.g., forward bottom portion of the flow passage structure 76 and adjacent support structure portion).

In certain embodiments, adjacent regions of the support structure portions 74 and the flow passage structures 76 facing the exit cavity 56 form steps to minimize flow tripping (e.g., turbulent flow) for the various flows flowing along these components of the inducer assembly 12 (see FIGS. 12 and 13). In particular, the inner surface 70 of each support structure portion 74 adjacent an aft bottom portion 86 of each flow passage structure 76 extends in the radial direction 58 beyond the aft bottom portion 86 to form a step. In certain embodiments, the step formed by the inner surface 70 of each support structure portion 74 extends at least approximately 0.254 millimeters (mm) (0.01 inches (in.)) beyond the adjacent aft bottom portion 86 of each flow passage structure 76. Also, a forward bottom portion 88 of each flow passage structure 76 extends in the radial direction 58 beyond the adjacent inner surface 70 of each support structure portion 74 to form a step. In certain embodiments, the step formed by the forward bottom portion 88 of each flow passage structure 76 extends at least approximately 0.254 mm (0.01 in.) beyond the adjacent inner surface 70 of each support structure portion 74.

As described in greater detail below, the discharge regions (e.g., scoops) of the flow passages 66 include a contoured design. The contoured design of the discharge regions of the flow passages 66 may increase the efficiency of the inducer assembly 12 by minimizing the mixing losses (e.g., pressure drop) as the inducer fluid flow 78 merges with the exit cavity fluid flow 82. The increased efficiency of the inducer assembly 12 results in more cavity swirl and lower relative temperatures for the cooling fluid flow 84. The lower temperatures in the cooling fluid flow 84 may reduce flow requirements for cooling the turbine blades 48, improve the life of the blades 48, and improve the overall performance of the gas turbine engine 10.

Figure 3:
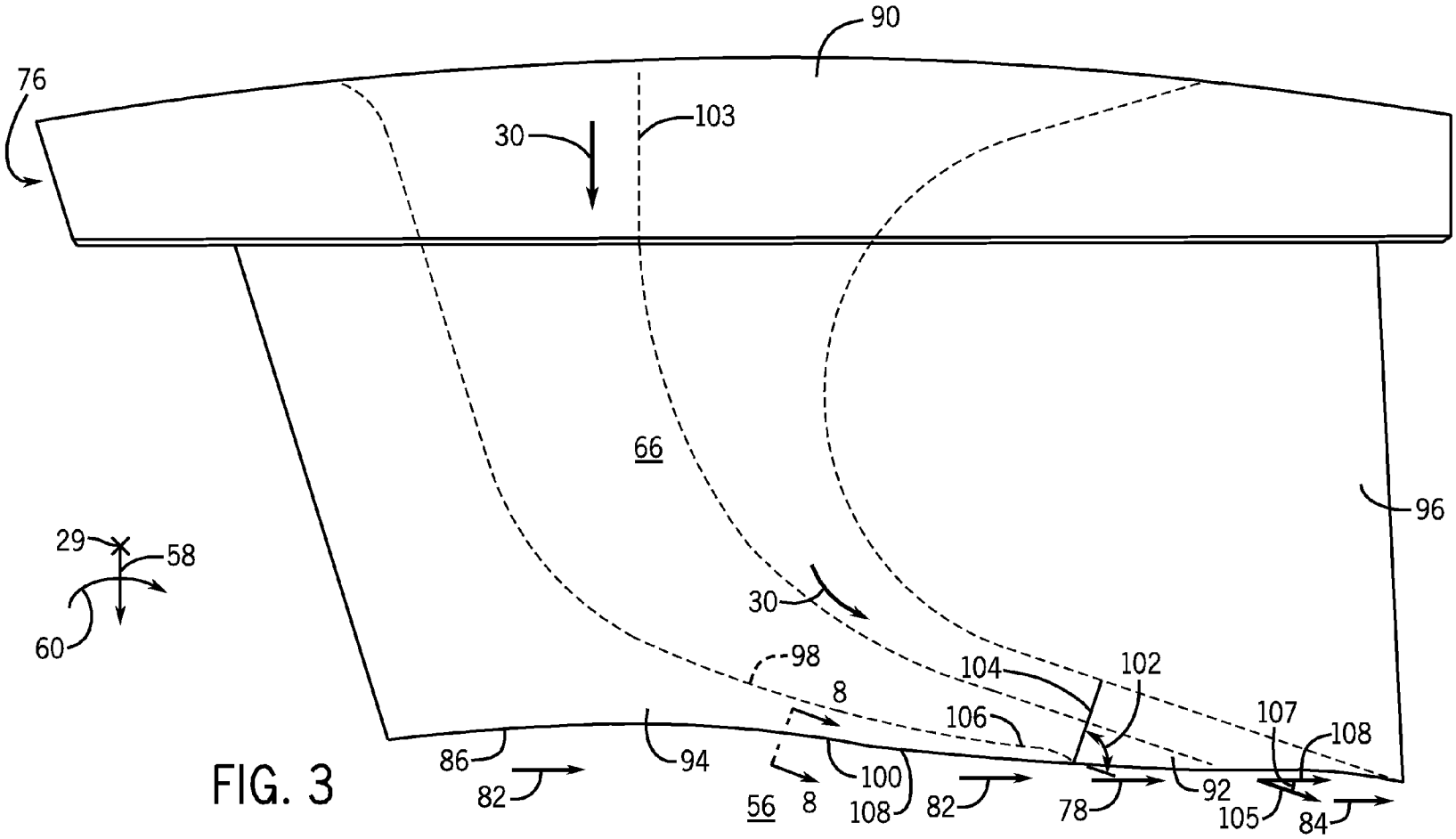
FIG. 3 is a cross-sectional view of an embodiment of a flow passage structure of FIG. 2 taken within line 3-3.

FIGS. 3-13 describe the flow passage structures 76 in greater detail. FIG. 3 is a cross-sectional view of an embodiment of one of the flow passage structures 76 of FIG. 2 taken within line 3-3. The flow passage structure 76 defines the flow passage 66. The flow passage 66 includes an inlet 90 to receive the fluid flow 30 and an outlet 92 to discharge the fluid flow 30 into the exit cavity 56. Each structure 76 includes a first wall portion 94 and a second wall portion 96 that each extends between the inlet 90 and the outlet 92 to define the flow passage 66. In certain embodiments, the flow passage structure 76 is made from a single part (e.g., cast monolith). In other embodiments, the flow passage structure 76 is made of two or more parts (e.g., machined in two halves). For example, the wall portion 94 may be a separately machined part from the second wall portion 96.

The first wall portion 94 includes surface 98 (e.g., curved surface) and surface 100. The inlet 90 receives the fluid flow 30 in a generally radial direction 58 and the surface 98 turns the received fluid flow 30 in a substantially circumferential direction 60 into the exit cavity 56. In particular, the surface 98 enables the exit of the fluid flow 30 into the exit cavity 56 in a substantially tangential direction, as indicated by arrow 78, relative to the cross-sectional area 80 (see FIGS. 1 and 2) of the exit cavity 56. The fluid flow 30 exits the flow passage 66 at an exit flow angle 102 ranging between approximately 60 to 90 degrees, 60 to 75 degrees, 75 to 90 degrees, and all subranges therebetween relative to an exit plane 104 (e.g., radial exit plane) at the outlet 92. For example, the exit flow angle 102 may be approximately 60, 65, 70, 75, 80, 85, or 90 degrees, or any other angle. Specifically, the fluid flow 30 exits the flow passage 66 along a center line 103, as indicated by arrow 105, at an angle 107 relative to a tangential flow 108. A smaller angle 107 induces more swirl within the cavity 56 circumferentially 60 and enables the inducer fluid flow 78 to exit more tangentially relative to the cross-sectional area 80 of the cavity 56. The angle 107 may range from approximately 0 to 30 degrees, 0 to 20 degrees, 0 to 10 degrees, and all subranges therebetween. For example, the angle 107 may be approximately 0, 5, 10, 15, 20, 25, or 30 degrees, or any other angle. The exiting fluid flow 78 (e.g., inducer fluid flow) merges with the exit cavity fluid flow 82 to form the cooling medium 84 (e.g., cooling fluid flow). In addition, the exiting fluid flow 78 imparts swirl in the cooling fluid flow 84 in the circumferential direction 60.

As described in greater detail below, in certain embodiments, the surface 98 may be a separate part from the first wall portion 94 (see FIG. 4). For example, the first wall portion 94 may include a groove or recess for receiving the surface 98. Also, in certain embodiments, the surface 98 may include at least one groove or recess to straighten the fluid flow 30 in the direction of fluid flow 30 within the flow passage 66 prior to exiting the outlet 92 in the direction of fluid flow 30 within the flow passage 66. Alternatively, at least one plate may extend across a portion of the flow passage 66 between the wall portions 94 and 96 to straighten the fluid flow 30 in the direction of fluid flow 30 within the flow passage 66 prior to exiting from the outlet 92. Also, in some embodiments, the surface 98 may include at least one projection (see FIGS. 5-7) extending from the surface 98 substantially perpendicular to a direction of the fluid flow 30 from the inlet 90 to the outlet 92 to trip the flow (e.g., to minimize unwanted tone or noise/vibration due to turbulence within the flow).

As depicted, the first wall portion 94 includes an end portion 106 adjacent the outlet 92. The surface 100 adjacent the outlet 92 extends into the exit cavity 56 (e.g., relative to an aft bottom or inner surface portion 86 of the flow passage structure 76). In particular, the surface 100 includes a smoothly contoured curve 108 at the end portion 106. The smoothly contoured curve 108 enables the surface 100 to guide a portion of the cavity fluid flow 82 away from the fluid flow 78 (inducer fluid flow) exiting the flow passage 66 at the outlet 92. As described in greater detail below, in certain embodiments, the first wall portion 94 may include at least one groove (see FIG. 8) in the surface 100 and/or at least one hole (see FIG. 9) through the surface 100 to draw a portion of the cavity fluid flow 82 into the fluid flow 78 exiting the outlet 92 to enable smoother mixing (e.g., less turbulent) of the flows 78, 82.

Figure 4:
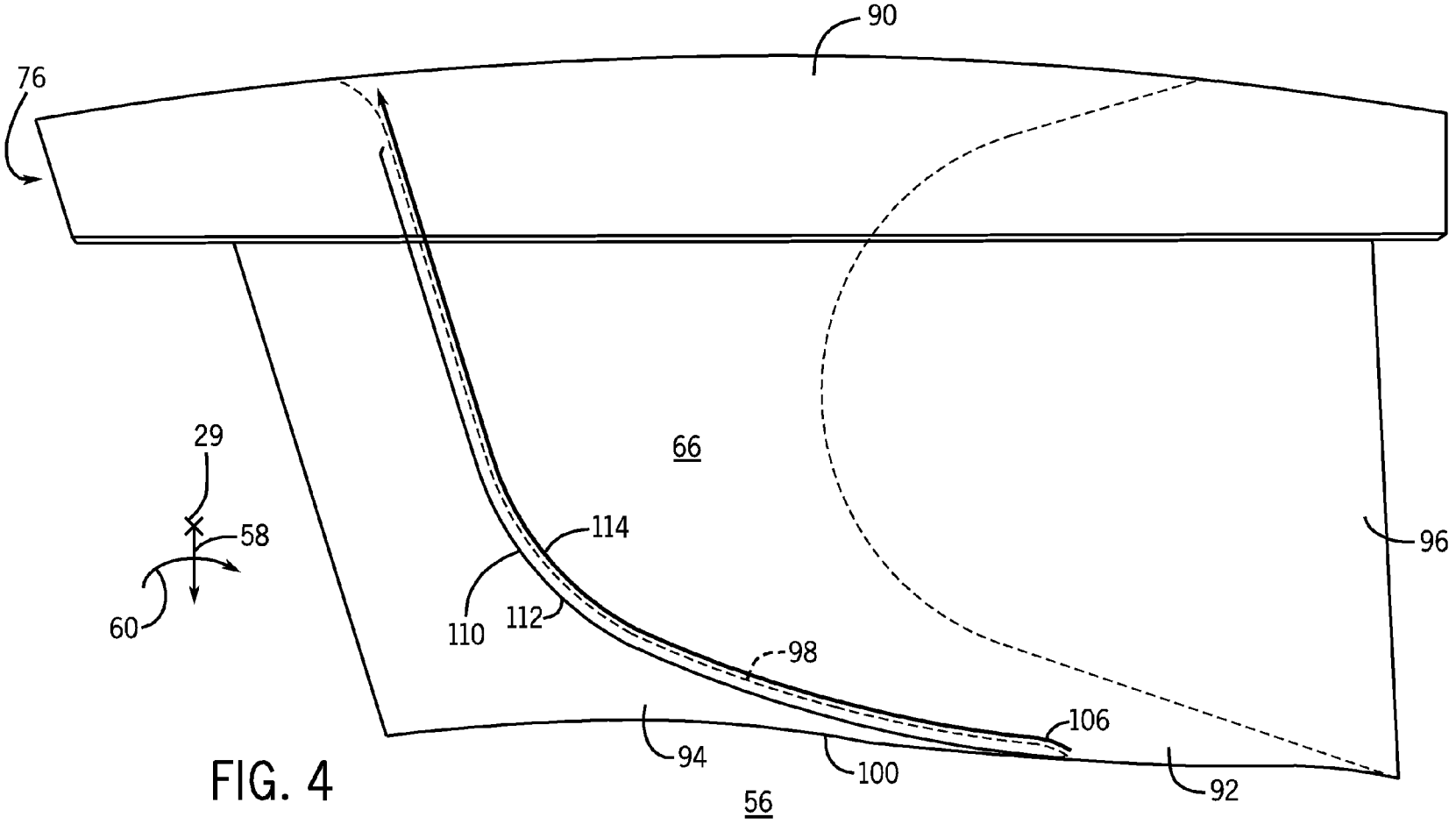
FIG. 4 is a cross-sectional view of an embodiment of the flow passage structure of FIG. 2, taken within line 3-3, having a first wall portion made of multiple parts.

FIG. 4 is a cross-sectional view of an embodiment of the flow passage structure 76 of FIG. 2 having the first wall portion 94 made of multiple parts, taken within line 3-3. The flow passage structure 76 is generally as described in FIG. 3. As depicted in FIG. 4, the first wall portion 94 includes a groove or recess 110 that extends along an inner surface 112 of the first wall portion 94. The groove 110 may extend along a portion or an entirety of a length 114 of the inner surface 112. The groove 110 may extend approximately 5 to 100 percent, 5 to 30 percent, 30 to 60 percent, 60 to 80 percent, 80 to 100 percent, and all subranges therebetween along the length 114 of the inner surface 112. For example, the groove 110 may extend approximately 5, 10, 20, 30, 40, 50, 60, 70, 80, 90, or 100 percent, or any other percent, along the length 114 of the inner surface 112. The flow passage structure 76 includes the surface 98 (e.g., an insert or a part separate from wall portion 94) disposed within the groove 110. The use of an insert for surface 98 enables the surface 98 to be replaced. In addition, the use of the insert may enable the machining of complex designs on the surface 98. As described in greater detail below, in certain embodiments, the surface 98 may include at least one groove or recess (see FIG. 7) to straighten the fluid flow 30 in the direction of the fluid flow 30 through the flow passage 66 prior to exiting from the outlet 92. Also, in some embodiments, the surface 98 may include at least one projection (see FIGS. 5-7) extending from the surface 98 substantially perpendicular to a direction of the fluid flow 30 from the inlet 90 to the outlet 92 to trip the flow (e.g., to minimize unwanted tone or noise/vibration due to turbulence within the flow).

Figure 5:
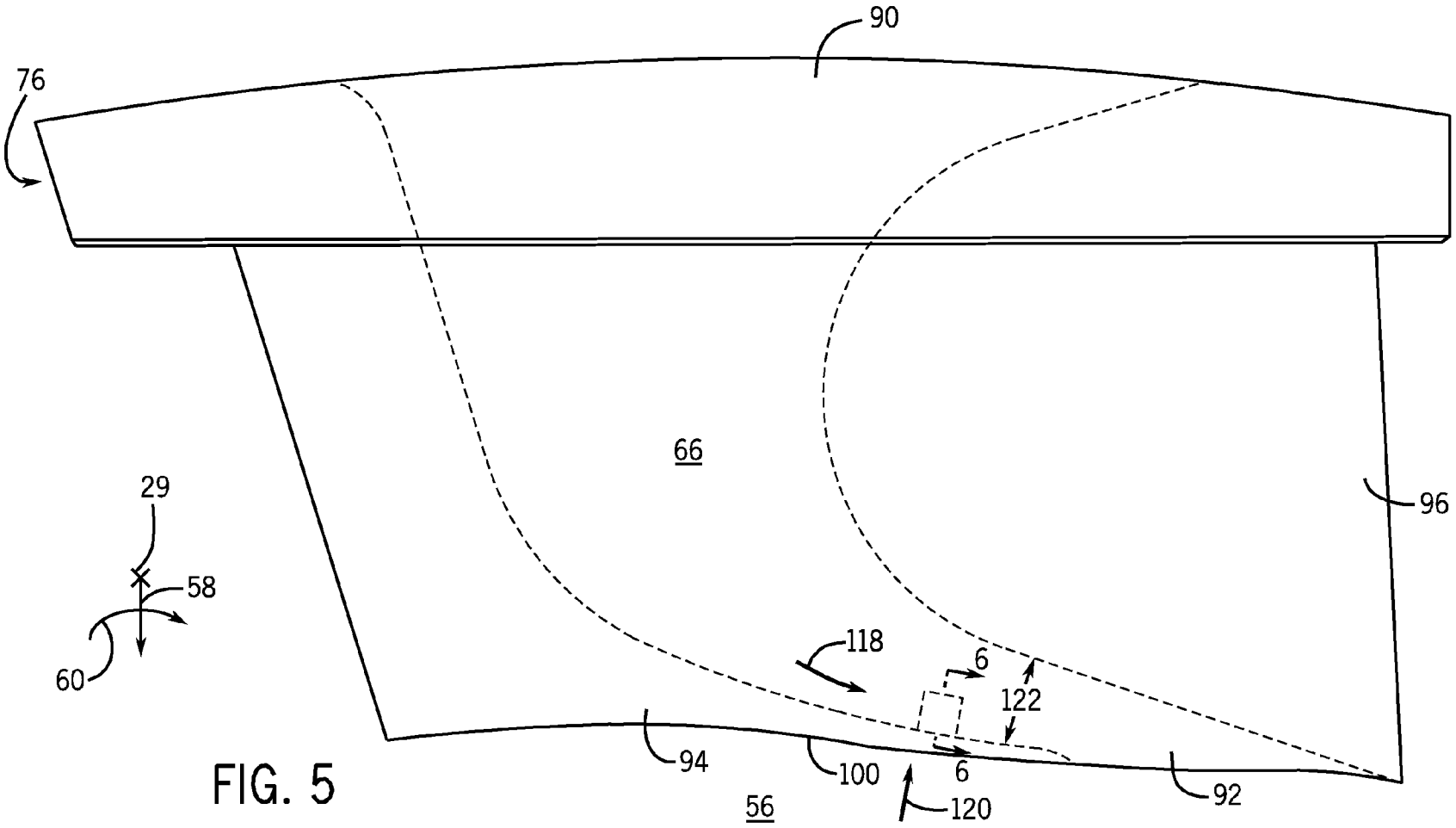
FIG. 5 is a cross-sectional view of an embodiment of the flow passage structure of FIG. 2, taken within line 3-3, having at least one projection extending from a surface of a first wall portion.
Figure 6:
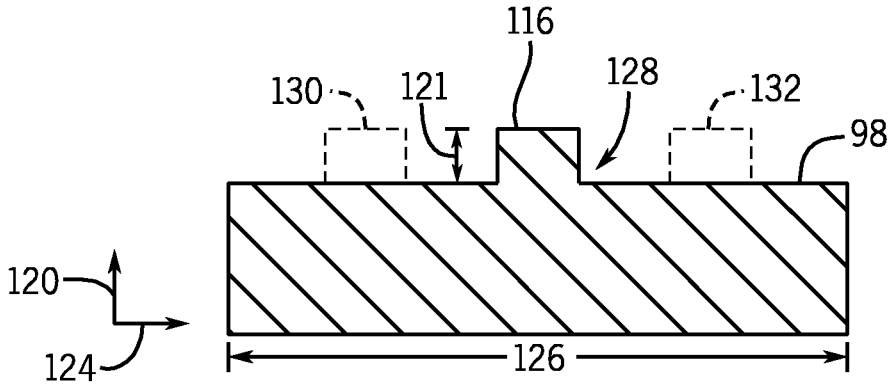
FIG. 6 is a cross-sectional view of an embodiment of the surface of the first wall portion of the flow passage structure of FIG. 5, taken along line 6-6, having at least one projection.

FIG. 5 is a cross-sectional view of an embodiment of the flow passage structure 76 of FIG. 2, taken within line 3-3, having at least one projection 116 extending from the surface 98 of the first wall portion 94. FIG. 6 is a cross-sectional view of the surface 98 of the first wall portion 94 of the flow passage structure 76 of FIG. 5, taken along line 6-6, having at least one projection 116. The surface 98 may be integral to or separate from the first wall portion 94 (e.g., insert) as described above. In addition, the surface 98 is as described above. As depicted in FIGS. 5 and 6, the surface 98 includes projection 116 extending from the surface 98 substantially perpendicular or traverse to a direction 118 of the fluid flow 30 from the inlet 90 to the outlet 92. The projection 116 trips the fluid flow 30 (e.g., to minimize unwanted tone or noise/vibration due to turbulence within the flow). The projection 116 extends generally in a radial direction 120 approximately 1 to 30 percent, 1 to 15 percent, 15 to 30 percent, and all subranges therebetween, across a distance 122 of the flow passage 66 between the wall portions 94, 96. For example, a height 121 of the projection 116 may extend approximately 1, 5, 10, 15, 20, 25, or 30 percent, or any other percent, across the distance 122. Also, the projection 116 may be located at any point axially 124 along a width 126 of the surface 98. As depicted in FIG. 6, the projection 116 is located along a central portion 128 of the width 126 of the surface 98. Alternatively, the projection 116 may be located towards a periphery of the width 126 (e.g., projections 130, 132). Further, as depicted in FIG. 6, the surface 98 may include multiple projections 116, 130, 132 along the width 126. In certain embodiments, the multiple projections 116, 130, 132 may be offset with respect to each other (e.g., staggered) along the surface 98 in the direction 118 of the fluid flow 30. In some embodiments, the heights 121 of the projections 116, 130, 132 may vary between each other. As depicted, the projections 116, 130, 132 include a rectilinear cross-sectional area. In certain embodiments, the projections 116, 130, 132 may have different cross-sectional areas (e.g. triangular, curved, etc.). The number of projections 116, 130, 132 along the surface 98 may vary from 1 to 50.

Figure 7:
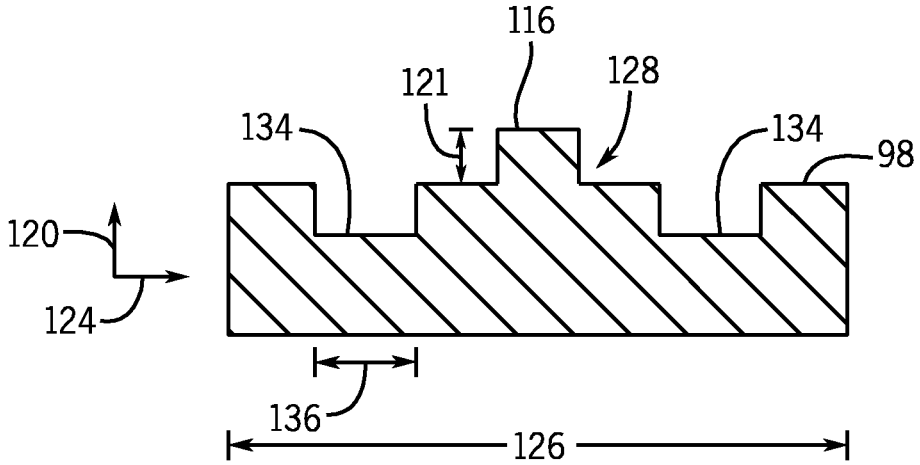
FIG. 7 is a cross-sectional view of an embodiment of a surface of the first wall portion of the flow passage structure of FIG. 5, taken along line 6-6, having at least one projection and at least one recess or groove.

FIG. 7 is a cross-sectional view of an embodiment of the surface 98 of the first wall portion 94 of the flow passage structure 76 of FIG. 3, taken along line 6-6, having at least one projection 116 and at least one recess or groove 134. The projection 116 is as described above in FIGS. 5 and 6. The surface 98 includes multiple recesses or grooves 134 that extend lengthwise along the surface 98 in the flow direction 118 from the inlet 90 toward the outlet 92. The grooves 134 straighten the fluid flow 30 in the flow direction 118 prior to exiting from the outlet 92. The number of grooves 134 may range from 1 to 10. In certain embodiments, the surface 98 may include grooves 134 without projections 116, 130, 132. A width 136 of each groove 134 may extend axially 124 approximately 1 to 50 percent, 1 to 25 percent, 25 to 50 percent, 1 to 15 percent, 35 to 50 percent, and all subranges therebetween along the width 126 of the surface 98. For example, the width 136 of each groove 134 may extend approximately 1, 5, 10, 15, 20, 25, 30, 35, 40, 45, or 50 percent, or any or percent along the width 126 of the surface 98. As depicted in FIG. 7, the grooves 134 are located towards the periphery of the width 126. In certain embodiments, the grooves 134 may be located towards the central portion 128 of the width 126 of the surface 98. As depicted, the grooves 134 include a rectilinear cross-sectional area. In certain embodiments, the grooves 134 may have different cross-sectional areas (e.g. triangular, curved, etc.).

Figure 8:
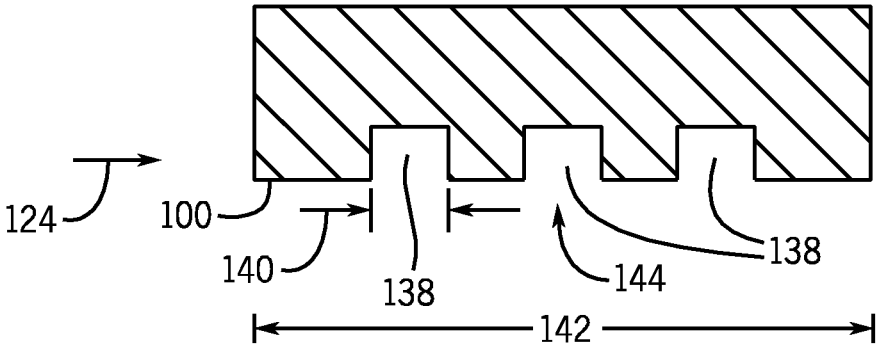
FIG. 8 is a cross-sectional view of an embodiment of a surface of the first wall portion of the flow passage structure of FIG. 3, taken along line 8-8, having recesses or grooves.

FIG. 8 is a cross-sectional view of an embodiment of the surface 100 of the first wall portion 94 of the flow passage structure 76 of FIG. 3, taken along line 8-8, having recesses or grooves 138. The surface 100 is as described above. The surface 100 includes multiple recesses or grooves 138 extending lengthwise along a flow direction of the cavity air flow 82 (see FIG. 3). The grooves 138 draw a portion of the cavity air flow 82 within and into the fluid flow 78 exiting from the outlet 92 (see FIG. 3) to enable smoother mixing (e.g., less turbulent) of the flows 78, 82. The number of grooves 138 may range from 1 to 10. A width 140 of each groove 138 may extend axially 124 approximately 1 to 50 percent, 1 to 25 percent, 25 to 50 percent, 1 to 15 percent, 35 to 50 percent, and all subranges therebetween, along a width 142 of the surface 100. For example, the width 140 of each groove 138 may extend approximately 1, 5, 10, 15, 20, 25, 30, 35, 40, 45, or 50 percent, or any or percent along the width 142 of the surface 100. As depicted in FIG. 8, the grooves 138 are located towards the periphery and a central portion 144 of the width 142. As depicted, the grooves 138 include a rectilinear cross-sectional area. In certain embodiments, the grooves 138 may have different cross-sectional areas (e.g., triangular, curved, etc.).

Figure 9:
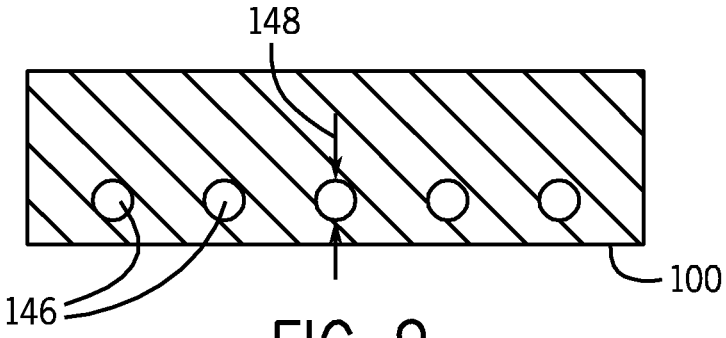
FIG. 9 is a cross-sectional view of an embodiment of the surface of the first wall portion of the flow passage structure of FIG. 3, taken along line 8-8, having holes.

FIG. 9 is a cross-sectional view of an embodiment of the surface 100 of the first wall portion 94 of the flow passage structure 76 of FIG. 3, taken along line 8-8, having holes 146. The surface 100 is as described above. The surface 100 includes multiple holes 146 that extend through the first wall portion 94 in a flow direction of the cavity air flow 82 (see FIG. 3) towards the outlet 92. The holes 146 draw a portion of the cavity air flow 82 within and into the fluid flow 78 exiting from the outlet 92 (see FIG. 3) to enable smoother mixing (e.g., less turbulent) of the flows 78, 82. The number of holes 146 may range from 1 to 20. A diameter 148 of each hole 146 may range from approximately 1 to 3 percent of the effective area of the flow passage 66. For example, the diameter 148 may be 0.3175 cm (0.125 in.), if the effective area of the passage 66 is 6.4516 $cm^2$ (1 $in.^2$), or any other diameter. The diameters 148 of the holes 146 may be uniform or vary between each other. As depicted, the holes 146 include an elliptical cross-sectional area. In certain embodiments, the holes 146 may have different cross-sectional areas (e.g. triangular, rectilinear, circular, etc.).

Figure 10:
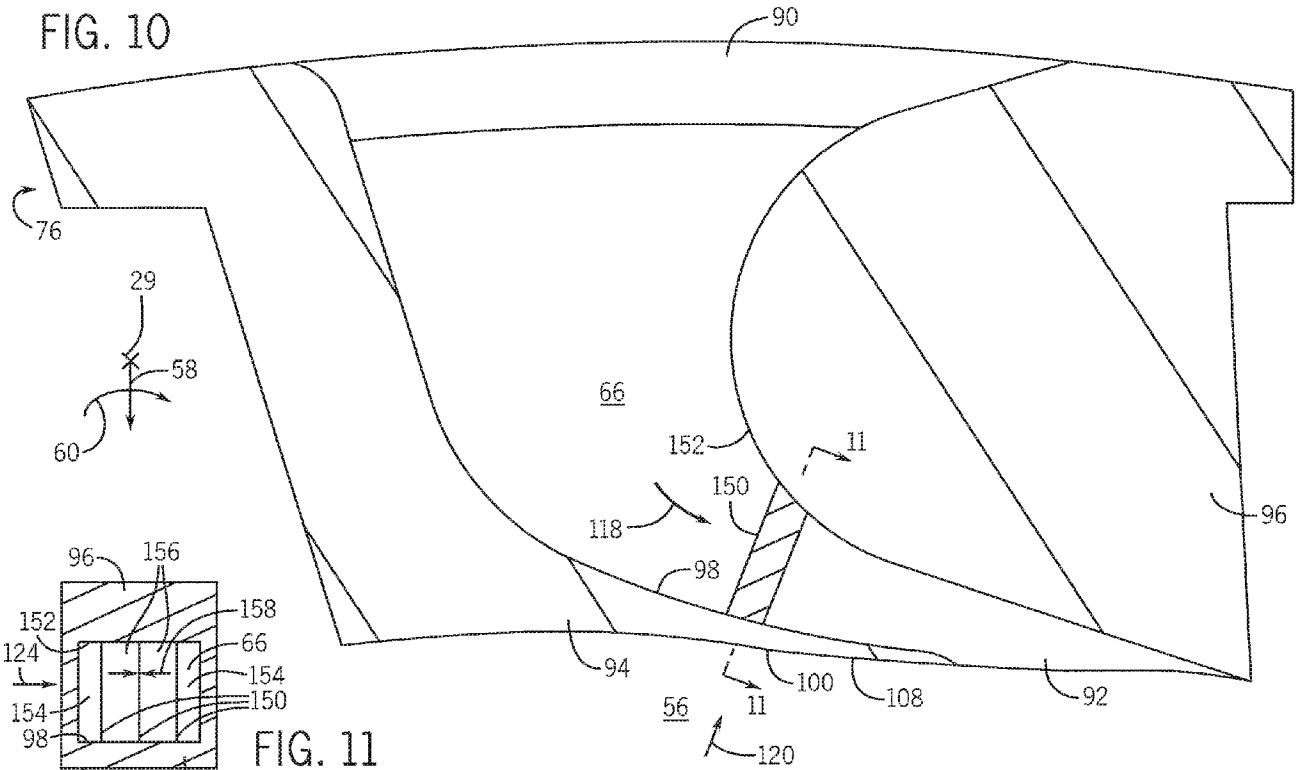
FIG. 10 is a cross-sectional view of an embodiment of the flow passage structure of FIG. 2, taken within line 3-3, having at least one plate extending between a first wall portion and a second wall portion within a flow passage.
Figure 11:
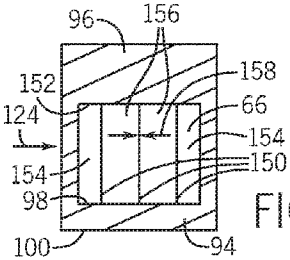
FIG. 11 is a cross-sectional view of an embodiment of plates extending between the first wall portion and the second wall portion within the flow passage of the flow passage structure of FIG. 10, taken along line 11-11.

FIG. 10 is a cross-sectional view of an embodiment of the flow passage structure 76 of FIG. 2, taken within line 3-3, having at least one plate 150 extending between the first wall portion 94 and the second wall portion 96 within the flow passage 66. FIG. 11 is a cross-sectional view of an embodiment of multiple plates 150 extending between the first wall portion 94 and the second wall portion 96 within the flow passage 66 of the flow passage structure 76 of FIG. 10, taken along line 11-11. The flow passage structure 76 is as described above. As depicted in FIGS. 10 and 11, the flow passage structure 76 includes multiple plates 150 aligned with the flow direction 118. The plates 150 straighten the fluid flow 30 in the flow direction 118 prior to exiting from the outlet 92. The number of plates 150 may range from 1 to 10. The plates 150 generally extend in the radial direction 120 between the surface 98 of the first wall portion 94 and surface 152 of the second wall portion 96. The plates 150 may be axially 124 disposed along a periphery 154 and/or a central portion 156 of the flow passage 66. A width (thickness) 158 of each plate 150 may range from approximately 0.762 cm (0.03 in.) to 0.254 cm (0.1 in.).

As mentioned above, adjacent regions of the support structure portions 74 and the flow passage structures 76 facing the exit cavity 56 form steps to minimize flow tripping (e.g., turbulent flow) for the various flows flowing along these components of the inducer assembly 12. FIG. 12 is a partial view of an embodiment of a portion of the inducer assembly 12 of FIG. 2 taken within line 12-12 (e.g., support structure portion 74 and adjacent aft bottom portion 86 of the flow passage structure 76). As depicted, the inner surface 70 of the support structure portion 74 adjacent the aft bottom portion 86 of the flow passage structure 76 extends in the radial direction 58 beyond the aft bottom portion 86 (e.g., surface 100 of the first wall portion 94) to form a step 164. In certain embodiments, the step 164 formed by the inner surface 70 of the support structure portion 74 extends a distance 166 of at least approximately 0.254 millimeters (mm) (0.01 inches (in.)) beyond the adjacent aft bottom portion 86 of the flow passage structure 76. The step 164 minimizes flow tripping for the various flows flowing along the support structure portion 74 and flow passage structure 76 in direction 167.

FIG. 13 is a partial view of an embodiment of a portion of the inducer assembly 12 of FIG. 2 taken within line 13-13 (e.g., forward bottom portion 88 of the flow passage structure 76 and adjacent support structure portion 74). As depicted, the forward bottom portion 88 (e.g., surface 152 of the second wall portion 96) of the flow passage structure 76 extends in the radial direction 58 beyond the adjacent inner surface 70 of the support structure portion 74 to form a step 168. In certain embodiments, the step 168 formed by the forward bottom portion 88 of each flow passage structure 76 extends a distance 170 of at least approximately 0.254 mm (0.01 in.) beyond the adjacent inner surface 70 of each support structure portion 74. The step 168 minimizes flow tripping for the various flows flowing along the support structure portion 74 and flow passage structure 76 in direction 167.

Technical effects of the disclosed embodiments include providing an inducer assembly 12 (e.g., axial or radial inducer) for the gas turbine engine 10 with contoured shaped discharge regions to generate high swirl with a reduced pressure drop. In particular, the contoured design of the discharge regions (e.g., first wall portion 94) of the inducer 12 may increase the efficiency of the inducer assembly 12 by minimizing the mixing losses (e.g., pressure drop) as the inducer fluid flow 78 merges with the exit cavity fluid flow 82. The increased efficiency of the inducer assembly 12 results in more cavity swirl and lower relative temperatures for the cooling fluid flow 84. The lower temperatures in the cooling fluid flow 84 may reduce bucket flow requirements, improve bucket life, and improve the overall performance of the gas turbine engine 10.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A system, comprising:

an inducer assembly configured to receive a fluid flow from a fluid source and to turn the fluid flow in a substantially circumferential direction into an exit cavity, and the inducer assembly comprises:

a plurality of flow passages, each flow passage comprises an inlet configured to receive the fluid flow and an outlet configured to discharge the fluid flow into the exit cavity, and each flow passage is defined by a first wall portion and a second wall portion extending between the inlet and the outlet, and the first wall portion comprises a first surface adjacent the outlet that extends into the exit cavity, wherein the first wall portion of each flow passage comprises a second surface, wherein the second surface is configured to turn the fluid flow in the substantially circumferential direction and to enable exit of the fluid flow from the outlet in a substantially tangential direction relative to an annular cross-sectional area of the exit cavity, and wherein the first wall portion comprises a groove, the first wall portion and the second surface are separate parts, and the second surface is disposed on an insert within the groove.

2. A system, comprising:

an inducer assembly configured to receive a fluid flow from a fluid source and to turn the fluid flow in a substantially circumferential direction into an exit cavity, and the inducer assembly comprises:

a plurality of flow passages, each flow passage comprises an inlet configured to receive the fluid flow and an outlet configured to discharge the fluid flow into the exit cavity, and each flow passage is defined by a first wall portion and a second wall portion extending between the inlet and the outlet, and the first wall portion comprises a first surface adjacent the outlet that extends into the exit cavity; and an annular support structure circumferentially configured to be disposed about a rotational axis of a gas turbine engine having an inner surface adjacent the exit cavity and an outer surface, and the plurality of flow passages are disposed circumferentially about the support structure between the inner surface and the outer surface, and wherein the inner surface of a portion of the annular support structure adjacent an aft portion of the first surface of each flow passage extends in a radial direction beyond the aft portion of the first surface and is configured to minimize flow tripping, the second wall portion comprises a second surface, and a forward portion of the second surface of each flow passage extends in the radial direction beyond an adjacent portion of the inner surface of the support structure and is configured to minimize flow tripping.

* * * * *